US005992650A

United States Patent [19]

Lord

[11] Patent Number: 5,992,650

[45] Date of Patent: Nov. 30, 1999

[54] AUTOMATIC MERCHANDISE FACING SYSTEM

[76] Inventor: Michael G. Lord, 550 N. Katie Way., Kuna, Id. 83634

[21] Appl. No.: 09/030,655

[22] Filed: Feb. 25, 1998

[51] Int. Cl.[6] ..... A47F 1/04

[52] U.S. Cl. ..... 211/59.2

[58] Field of Search ..... 211/59.2, 59.3, 211/74, 128.1, 49.1; 312/42

[56] References Cited

U.S. PATENT DOCUMENTS

| | | | |
|---|---|---|---|
| 4,128,177 | 12/1978 | Bostos | 211/49 D |
| 4,401,221 | 8/1983 | Suttles | 211/49 D |
| 4,598,828 | 7/1986 | Young et al. | 211/59.2 |
| 4,785,945 | 11/1988 | Rowse et al. | 211/59.2 |
| 5,531,336 | 7/1996 | Parham | 211/59.2 |
| 5,645,176 | 7/1997 | Jay | 211/59.2 |
| 5,862,923 | 1/1999 | Nordquist et al. | 211/59.2 |

*Primary Examiner*—Alvin Chin-Shue
*Assistant Examiner*—Sarah Purol
*Attorney, Agent, or Firm*—Joseph W. Holland

[57] ABSTRACT

An automatic merchandise facing system including a product support and display device having a product support member and a product orienting member to compel a preselected orientation of an information display surface of a product container having a product container alignment member. The product container support and display device may include a rail section projecting from the upper face of the container support surface and extending parallel to the length of the elongate channel. The automatic merchandise facing system also includes a product container having an information display surface and a product container alignment member aligned with respect to the information display surface. The product container alignment member may include any surface of the container which is aligned with respect to the information display surface and which is configured to cooperate with the product orienting member of the container support and display device. The product container alignment member be configured as a linear groove extending across the product container base for sliding engagement with the elongated track projecting from the upper face of the container support surface.

18 Claims, 5 Drawing Sheets

AUTOMATIC MERCHANDISE FACING SYSTEM

BACKGROUND OF THE INVENTION

1. Technical Field

The present invention relates to a system for displaying and supporting product containers and, more particularly, to a merchandise facing system including a product container support and display device including a product orienting member to compel a preselected orientation of a display surface of a product container having a product container alignment member.

2. Background

A variety of food products, including beverages, are displayed for retail sale on a variety of racks and shelving including horizontal shelving and inclined or gravity feed type shelving. Typically, the product containers are stocked on the shelves with the labels facing forward with an identical product and product container stocked just behind the lead or facing container. Often, the product containers may be supported and displayed on an inclined display rack as shown in Bostos, U.S. Pat. No. 4,128,177; Young et al., U.S. Pat. No. 4,598,828; Jay, U.S. Pat. No. 5,645,176; Parham et al., U.S. Pat. No. 5,531,336; and Suttles, U.S. Pat. No. 4,401,221. The devices disclosed in each of the above referenced patents provide a means for displaying product containers including a means for advancing the product to the front of the display by gravity feed. This is achieved through the use of an inclined member which supports the product container.

These referenced merchandising systems have solved the problem that exists with horizontal display, which typically lacks a means to advance the product to the front of the shelf following removal of the lead product container. Ultimately, these arrangements serve one purpose in terms of the product manufacturer or distributor's objectives, that being moving the product to the front of the display case so that a consumer standing in front of the product display can readily see the product container. This objective is of utmost concern to product manufacturers and distributors who spend literally millions of dollars annually on advertisement and marketing campaigns in an attempt to have the purchasing public readily recognize their product identity, whether in the form of labeling or in the form of specific product configurations. Jay, U.S. Pat. No. 5,645,176, discloses a display rack including a pair of laterally spaced upstanding walls and a planar track connecting the sidewalls and also includes a front member which, with the front of the track, defines an aperture through which a substantial portion of the lead article in the channel may be viewed.

Nevertheless, devices such as those disclosed in Jay still do not solve the problem of assuring that each product container placed on the display and dispensing rack or other device is properly faced, thereby displaying the product identification label directly towards the front of the dispensing unit.

A common arrangement between distributors and retailers includes the distributor's obligation to stock his product in a retail display. Most distributors, as a matter of practice, and many retailers, as a matter of policy, require the distributor to ensure that the product is properly faced in the display. That is, that the product's identification labeling, as opposed to the consumer information labeling, faces directly forward in the display racks. The distributor's personnel, as a matter of routine, then typically spends five to ten minutes per each delivery stop facing the existing and previously stocked product prior to restocking the retailer's supply. At an average of ten to twenty stops per day, each distributor's representative will spend an approximately an hour a day simply facing product which was previously stocked on the shelves so as to display uniformly the product's product identification labeling.

Even if the distributor's representative took the time to properly face each and every container placed behind the lead article when stocking, oftentimes a customer will remove the lead article from the display, and then replace it at a later time having made a choice not to purchase that article.

What is needed is a device that provides a means whereby each article that is placed in the display device will be faced with the product identification labeling faced towards the front of the display device simply by placement on the device.

SUMMARY OF THE INVENTION

According to the present invention, these and other objects are achieved by an automatic merchandise facing system including a product support and display device for supporting product and product containers. The product support and display device includes a product support member and a product orienting member for compelling a preselected orientation of an information display surface of a product container having a product container alignment member which is placed on the product support and display device. The product support and display device may be configured to provide for a sliding relation or cooperation between the product container and the product support and display device. In the alternative, the product support and display device may be configured to provide a stationary placement of the product container on the product support and display device. The product support and display device may be configured as an elongate channel having a longitudinal axis, the elongate channel defined by a pair of laterally spaced members. In one embodiment of the invention, the elongate channel is defined by a pair of substantially upright wall members and a container support surface connecting the pair of laterally spaced substantially upright wall members.

The product container support and display device includes a product orienting member. In one embodiment of the invention, the container support surface may include a rail section projecting from the upper face of the container support surface and extending parallel to the longitudinal axis of the elongate channel. Alternately, the product orienting member may be configured as an elongate channel having a longitudinal axis and defined by a pair of laterally spaced members having a predetermined distance between the pair of laterally spaced members, configured for supporting a product container having a neck of a preselected size and configuration. The required cooperation between the pair of laterally spaced members and the bottle neck may be achieved by configuring the neck of the container to include a surface or a flat creating an effective neck diameter which will be allowed through the pair of substantially parallel neck support tracks.

Alternately, the product orienting member may be configured as the elongate channel defined by a pair of substantially upright wall members and a container support surface connecting the pair of laterally spaced substantially upright wall members, the pair of upright wall members having a predetermined distance between the pair of upright wall members. The elongate channel is configured for supporting a product container, the sides of the container having a preselected side wall configuration configured to cooperate with the pair of upright wall members of the elongate channel. The required cooperation between the pair of upright wall members and the preselected side wall configuration may be achieved by configuring the sides of the container to include a surface or a flat creating an effective container diameter which will be allowed through the pair of upright wall members.

The automatic merchandise facing system also includes a product container having an outer peripheral surface connected to and extending above a product container base. The product container may also include an information display surface and a product container alignment member aligned with respect to the information display surface to compel a preselected orientation of the information display surface when the product container is placed on a product container support and display surface having a product orienting member.

The product container alignment member may include any surface of the product container which is aligned with respect to the information display surface and which is configured to cooperate with the product orienting member of the container support and display device to compel a preselected orientation of the information display surface when the product container is placed in a product container support and display device having a product orienting member.

In one embodiment of the invention, the cooperation between the product orienting member and the product container alignment member is achieved by configuring the product container base to include a groove which is sized and shaped to achieve a free sliding fit with a rail section formed on the upper face of the container support surface. In the alternative, automatic product container facing may be achieved using more than one groove cooperating with more than one rail section.

Alternately, automatic product container facing may be achieved by configuring the sides of the container to include a surface which is configured to cooperate with the wall members of the elongate channel. Alternately, automatic product container facing may be achieved by configuring the neck of a container to include a surface which is configured to cooperate with a product container support and display device having a pair of substantially parallel laterally spaced neck support members.

The product container alignment member may include a linear groove extending across the product container base, the linear groove having a first end and a second end, the linear groove being opened at the first end and the second end for sliding engagement with a container alignment member.

The linear groove may be formed having a variety of cross-sectional configurations permitting a variety of products to be identifiable and distinguishable from one another simply based upon the configuration of the linear groove. Similarly, the product orienting member formed on the container support surface may be formed having a variety of cross-sectional configurations permitting a variety of products to be identifiable and distinguishable from one another simply based upon the configuration of the product orienting member. This feature will allow only those containers with a cooperating linear groove cross-sectional configuration to be stocked on a given product container support and display device.

The automatic merchandise facing system may also include an inclined container support surface which permits an automatic feed of product containers towards the forward portion of the container support surface. The automatic merchandise facing system may also include a front stop attached to the product container support and display device for limiting travel of the product containers beyond a front end of the product container support and display device.

The present invention may also be adapted for use on existing product container support and display device. A product orienting device for attachment to an existing product container support and display device having a container support base includes an elongate strip having a longitudinal axis and an upper face and a lower face. The upper face of the elongate strip includes a product orienting member projecting from the upper face of the elongate strip and means for attaching the elongate strip to the support and display passage. Typically, the means for attaching the elongate strip to the support and display passage includes an adhesive strip or backing applied to the lower face of the elongate strip for attachment to the upper face of the container support base. Other means are possible including a variety of mechanical fasteners.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

It should be understood that the referenced drawings are not to scale and are intended as representations. The drawings are not necessarily intended to depict the functional and structural details of the invention, which can be determined by one of skill in the art by examination of the descriptions and claims provided herein.

DETAILED DESCRIPTION OF THE INVENTION

Figure 1:
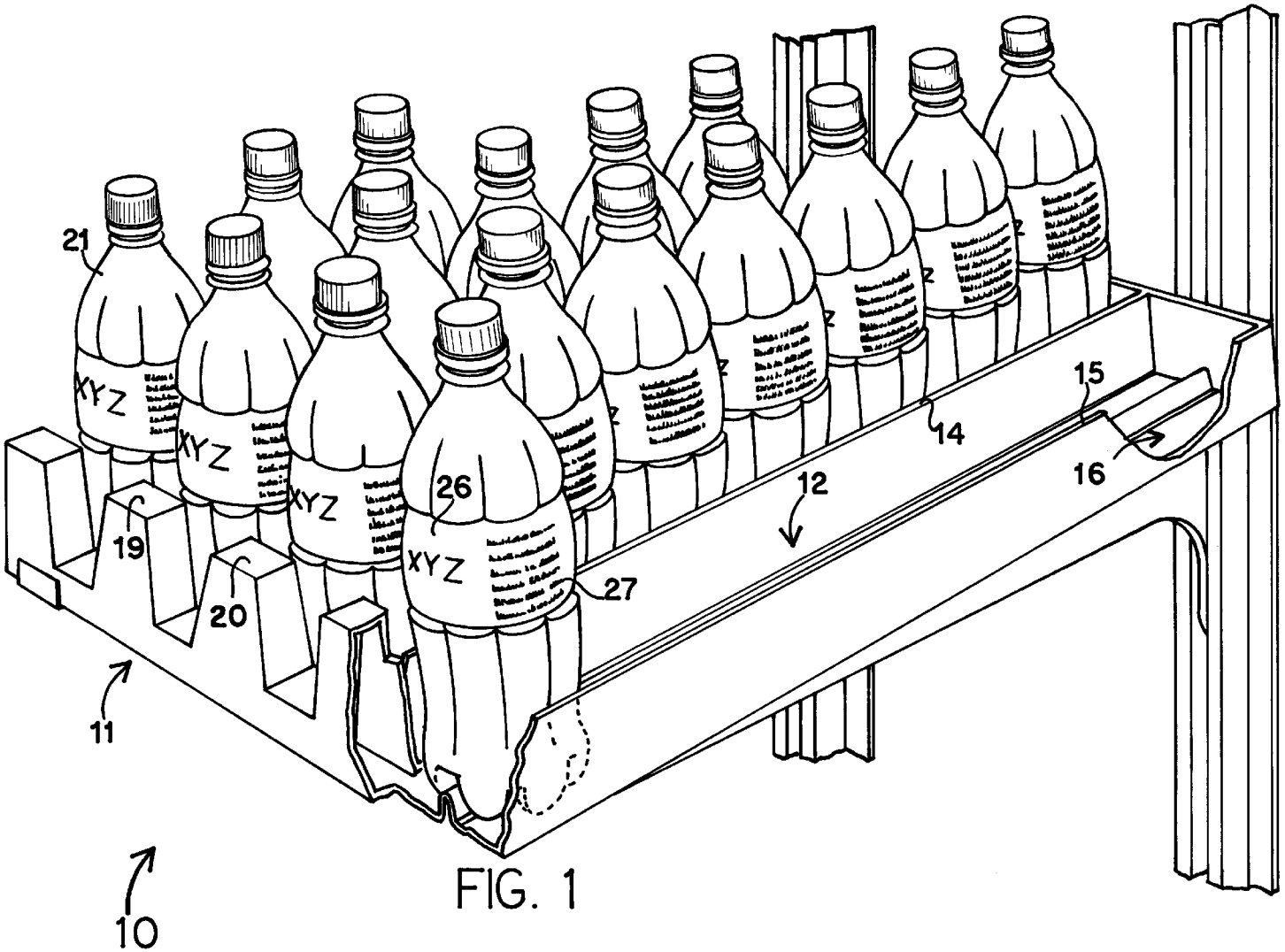
FIG. 1 is a perspective representational view of an inclined product container support and display device including an automatic product container facing system according to the present invention.

Referring now to FIGS. 1 through 6, the automatic merchandise facing system will be more fully described. Referring to FIG. 1, the automatic product container facing system 10 includes generally product container support and display device 11 which in turn may contain a plurality of product container support and display passages shown generally as channels 12. Each channel 12 may include a first wall member 14 and a second wall member 15 spaced laterally from one another and connected by container support surface 16. As shown in FIG. 1, each channel 12 includes a first side front stop 19 and a second side front stop 20.

Figure 2:
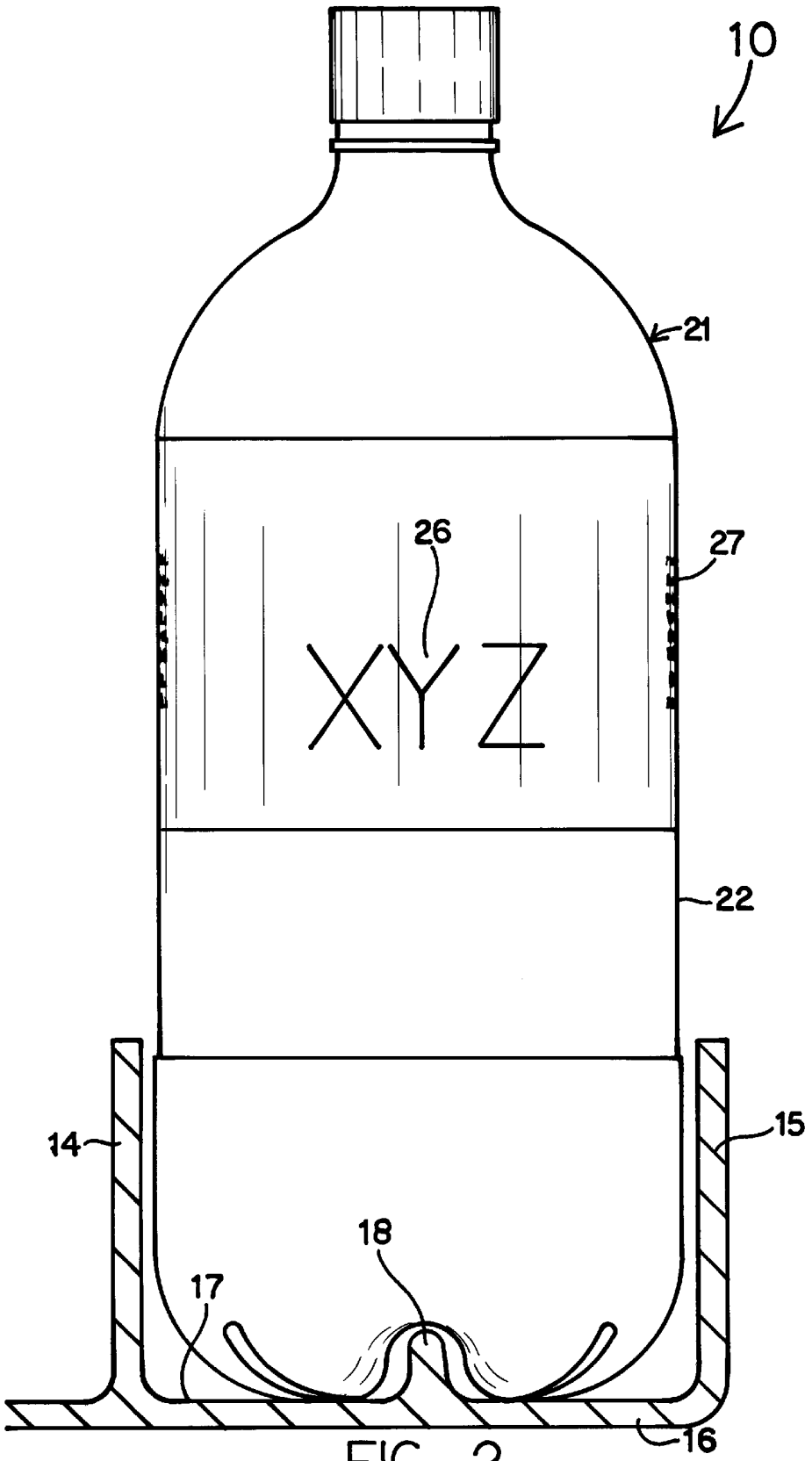
FIG. 2 is a front view of a product container support and display device and a product container according to the present invention.

Referring to FIG. 2, container support base 16 includes support base upper face 17 which may be configured to include a product orienting member. Here, the product orienting member includes support base upper face 17 configured having rail section 18.

Figure 3:
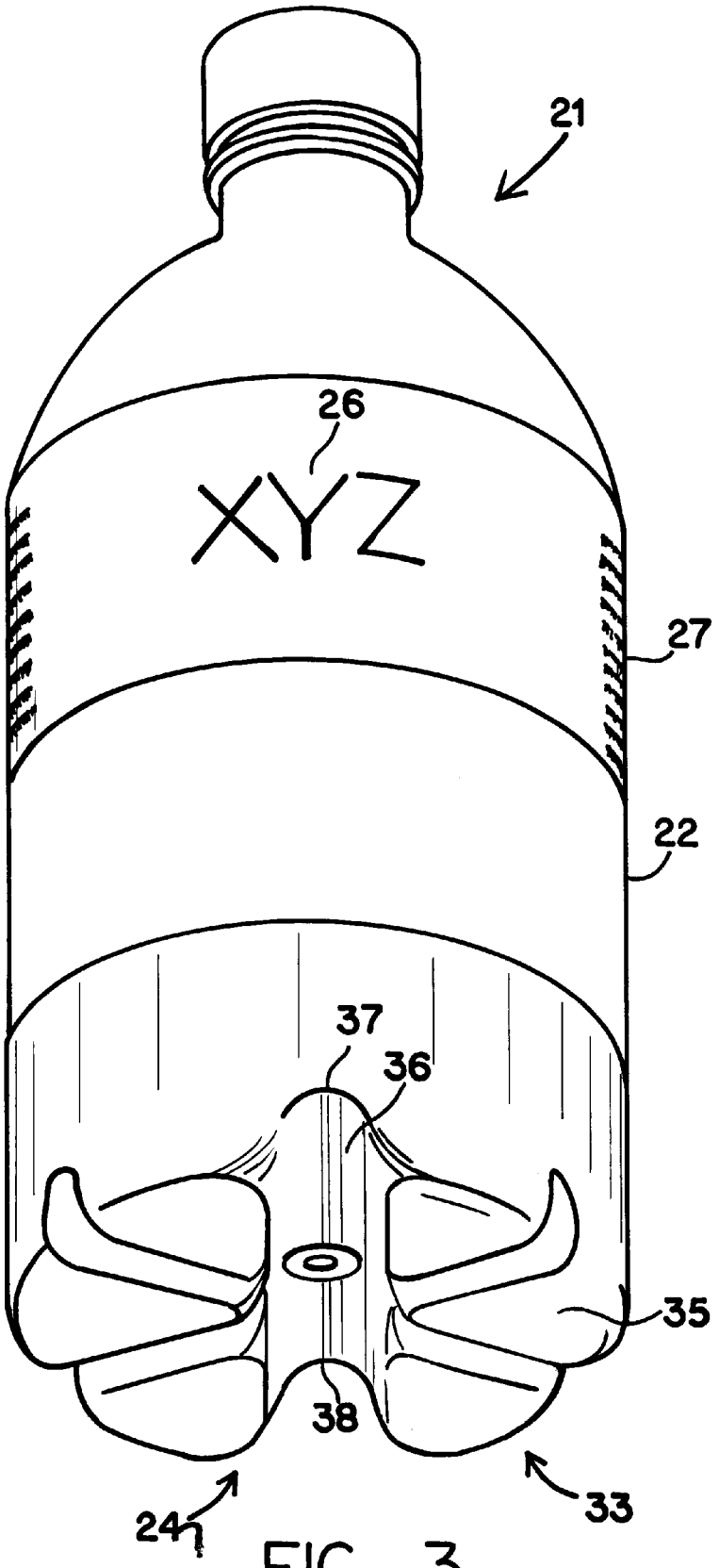
FIG. 3 is a perspective representational view of a product container according to the present invention.

Automatic product container facing system 10 also includes product container 21. Referring to FIG. 3, product container 21 includes outer peripheral surface 22 and product container base 24. As seen in FIG. 3, product container base 24 includes a distinctive footprint 33. Footprint 33 is characterized by a plurality of lobes 35. Footprint 33 also includes a product container alignment member, in this case linear groove 36. Linear groove 36 includes groove first flared end 37 and groove second flared end 38 which facilitates placement of product container 21 in the automatic product container facing system 10.

Figure 4:
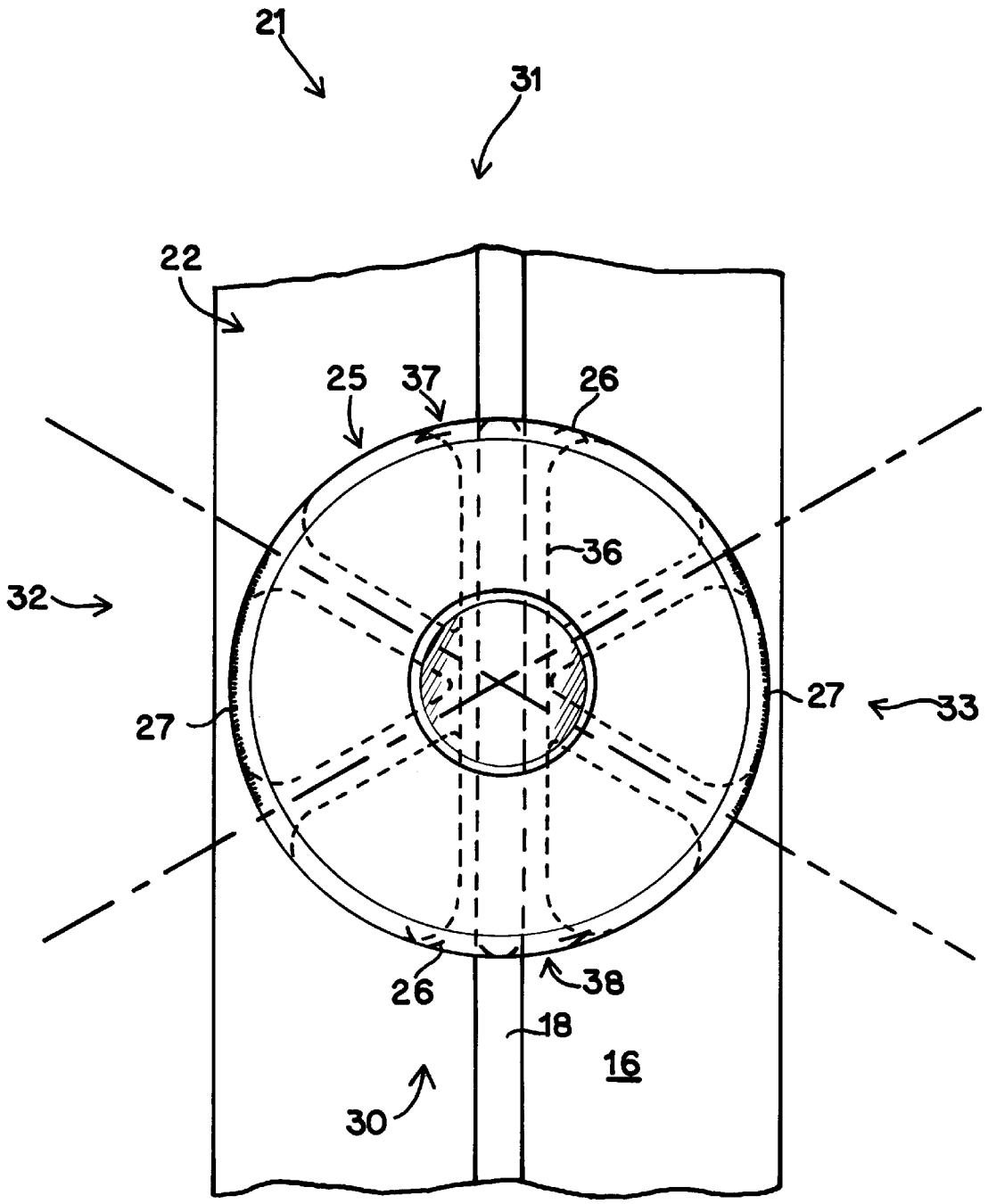
FIG. 4 is a top representational view of a product container according to the present invention.

Referring to FIG. 4, product container 21 is shown having container first segment 30, container second segment 31, container third segment 32 and container fourth segment 33. Container first segment 30 and container second segment 31 may each bear product identification label 26. Similarly, container third segment 32 and container fourth segment 33 may each bear consumer information labels 27. FIG. 4 also shows container support surface 16, here having rail section 18. The longitudinal axis of rail section 18 is parallel to the longitudinal axis of linear groove 36. This arrangement achieves the automatic merchandise facing feature of the invention. Each time a product container 21, having outer peripheral surface 22 and an information display surface 25, is placed on container support surface 16, having rail section 18, the combination of the configuration of product container 21 having linear groove 36 cooperating with rail section 18 compels a preselected orientation of product identification label 26, facing product identification label 26 towards the front of the product container support and display device 11 simply by placement on the device. As shown in FIG. 1, product information label 26 is viewable from the front portion of product container support and display device 11.

Figure 5:
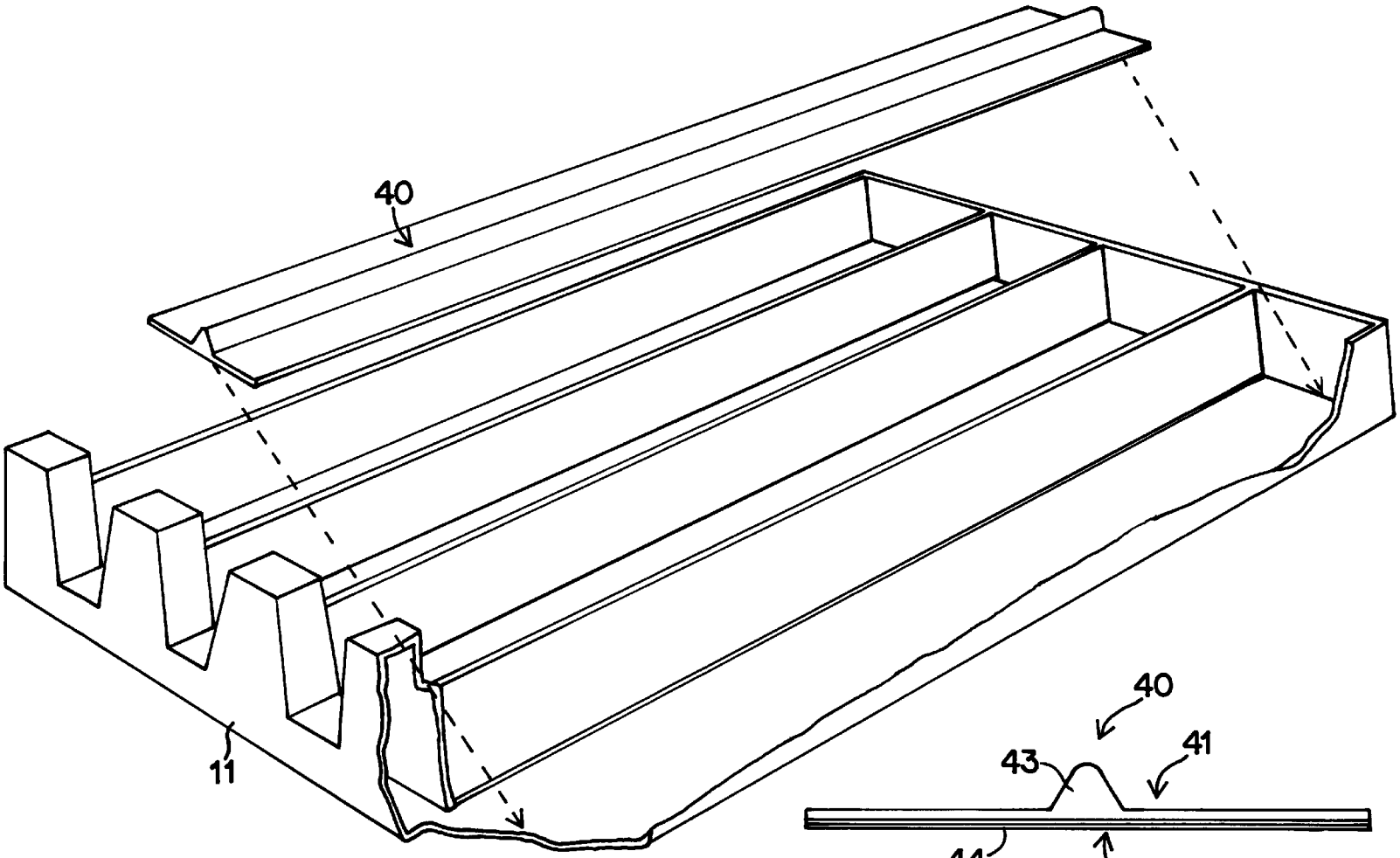
FIG. 5 is a perspective representational view of an adapter strip for attachment to an existing product container support and display device having a container support base.
Figure 6:
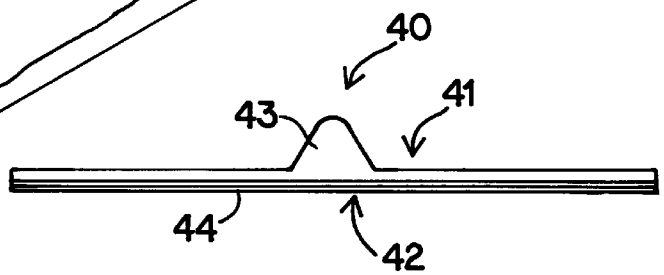
FIG. 6 is a representational end view of an adapter strip for attachment to an existing support and display device having a container support base.

Referring to FIG. 5, adapter strip 40 is shown for placement in a preexisting product container support and display device 11. FIG. 6 shows adapter strip 40 including adapter strip upper face 41, adapter strip lower face 42 and rail section 43 formed on adapter strip upper face 41. Lower face 42 includes peel and stick adhesive surface 44.

In use, referring to FIG. 1 through 4, product containers 21 are stocked in channels 12 of product container support and display device 11 typically from the rear of product container support and display device 11. Product containers 21 are placed into channels 12 so that product container base 24 rests upon support base upper face 17. Product containers 21 must be positioned on container support base 16 with linear groove 36 aligned with rail section 18 in order for lobes 35 of product container base 24 to contact support base upper face 17. When linear groove 36 is aligned with rail section 18, a preselected orientation of product identification label 26 is compelled wherein product identification label 26 is properly faced towards the front of product container support and display device 11. Product containers 21 are placed on container support base 16 with linear groove 36 aligned with rail section 18 with product containers 21 advancing until the first product container in channel 12 contacts first side front stop 19 and a second side front stop 20. As product containers 21 are withdrawn from product container support and display device 11 the remaining product containers 21 advance along the inclined container support base 16 to first side front stop 19 and a second side front stop 20. In the event that a customer removes the lead product container 21 from channel 12 and decides to return the same to the product container support and display device 11, linear groove 36 of product container 21 will be compelled to align with rail section 18 in order for lobes 35 of product container base 24 to contact support base upper face 17.

Referring to FIG. 4, the product container labeling may be configured so that it does not matter whether groove first flared end 37 or groove second flared end 38 engages rail section first, as either or both container first segment 30 and container second segment 31 may bear product identification label 26.

Referring to FIG. 5, adapter strip 40 may be placed on a preexisting product container support and display device 11. FIG. 6 shows adapter strip 40 including adapter strip upper face 41, adapter strip lower face 42 and rail section 43 formed on adapter strip upper face 41. Lower face 42 includes peel and stick adhesive surface 44.

While there is shown and described the preferred embodiment of the invention, it is to be distinctly understood that this invention is not limited thereto but may be variously embodied to practice within the scope of the following claims.

I claim:

1. A product container support and display device for an automatic merchandise facing system comprising:

a product support member including a product orienting member for compelling a preselected orientation of a display surface of a product container having a product container alignment member.

2. The product container support and display device of claim 1 wherein the product support member further comprises:

an elongate channel having a longitudinal axis, the elongate channel defined by a pair of laterally spaced substantially upright wall members and a container support base connecting the pair of laterally spaced upright wall members, the container support base including a product orienting member projecting from an upper face of the container support base and extending parallel to the longitudinal axis of the elongate channel to compel a specific orientation of a display surface of a product container when the product container is placed in the elongate channel.

3. The product container support and display device of claim 2 wherein the product orienting member further comprises a rail section projecting from the upper face of the container support base.

4. The product container support and display device of claim 3 wherein the rail section has a preselected cross-sectional configuration.

5. The product container support and display device of claim 1 further comprising a front stop attached to the support and display passage for limiting travel of the product containers beyond a front end of the elongate channel.

6. The product container support and display device of claim 2 wherein the container support base of the elongate channel further comprises an inclined container support base.

7. A product container comprising:

a product container base;

an outer peripheral surface extending above the product container base including an information display surface; and a product container alignment member aligned with respect to the information display surface to compel a preselected orientation of the information display surface when the product container is placed in a product container support and display device having a product orienting member.

8. The product container of claim 7 wherein the product container alignment member further comprises a linear groove extending across the product container base, the linear groove having a first end and a second end, the linear groove being opened at the first end and the second end for sliding engagement with a container alignment member.

9. The product container of claim 8 wherein the linear groove further comprises a preselected cross-sectional configuration.

10. An automatic product container facing system comprising:

a product container support and display device including a product support member having a product orienting member; and a product container including a product container base and an outer peripheral surface connected to and extending above the product container base, the product container also including an information display surface and a product container alignment member aligned with respect to the information display surface to compel a preselected orientation of the information display surface when the product container is placed in a product container support and display device having a product orienting member.

11. The product container support and display device of claim 10 wherein the product support member further comprises:

an elongate channel having a longitudinal axis the elongate channel defined by a pair of laterally spaced substantially upright wall members and a container support base connecting the pair of laterally spaced upright wall members, the container support base including a product orienting member projecting from an upper face of the container support base and extending parallel to the longitudinal axis of the elongate channel to compel a specific orientation of a display surface of a product container when the product container is placed in the elongate channel.

12. The product container support and display device of claim 11 wherein the product orienting member further comprises a rail section projecting from the upper face of the container support base.

13. The product container support and display device of claim 12 wherein the rail section has a preselected cross-sectional configuration.

14. The product container support and display device of claim 10 further comprising a front stop attached to the support and display passage for limiting travel of the product containers beyond a front end of the elongate channel.

15. The product container support and display device of claim 11 wherein the container support base of the elongate channel further comprises an inclined container support base.

16. The product container of claim 10 wherein the product container alignment member further comprises a linear groove extending across the product container base, the linear groove having a first end and a second end, the linear groove being opened at the first end and the second end for sliding engagement with a container alignment member.

17. The product container of claim 16 wherein the linear groove further comprises a preselected cross-sectional configuration.

18. A product orienting device for attachment to a product container support and display device including a container support surface comprising:

an elongate strip having a longitudinal axis and an upper face and a lower face, the upper face of the elongate strip including a product orienting member projecting from the upper face of the elongate strip; and means for attaching the elongate strip to the support and display passage.

* * * * *